United States Patent [19]

Kawasaki et al.

[11] Patent Number: 4,487,812

[45] Date of Patent: Dec. 11, 1984

[54] MAGNETIC AMORPHOUS ALLOY SHEET HAVING A FILM THEREON

[75] Inventors: Hironobu Kawasaki; Takashi Sato; Tomohiko Hayashi; Tsutomu Ozawa, all of Kawasaki, Japan

[73] Assignee: Nippon Steel Corporation, Tokyo, Japan

[21] Appl. No.: 514,016

[22] Filed: Jul. 15, 1983

[30] Foreign Application Priority Data

Jul. 22, 1982 [JP] Japan ..... 57-126789

[51] Int. Cl.[3] ..... C23C 3/02; C25D 5/12

[52] U.S. Cl. ..... 428/629; 428/472; 428/607; 428/623; 428/632; 428/928; 148/31.55

[58] Field of Search ..... 428/629, 623, 632, 928, 428/472, 607; 148/31.55

[56] References Cited

U.S. PATENT DOCUMENTS

| | | | |
|---|---|---|---|
| 3,799,814 | 3/1974 | Yamagishi et al. | 428/623 |
| 4,187,128 | 2/1980 | Billings et al. | 148/31.55 |
| 4,314,594 | 2/1982 | Pfeifer et al. | 428/629 |

FOREIGN PATENT DOCUMENTS 55481 7/1982 European Pat. Off. .

*Primary Examiner*—Veronica O'Keefe

*Attorney, Agent, or Firm*—Kenyon & Kenyon

[57] ABSTRACT

The present invention relates to a magnetic amorphous alloy sheet having an improved insulating property and improved corrosion resistance.

The present invention aims to provide a film which is used to cover the magnetic amorphous alloy sheet, thereby improving its corrosion resistance and increasing the layer insulation resistance, without impairing the magnetic properties.

The film according to the present invention has a thickness of up to 1 μm and comprises a chromium compound which comprises hydrated chromium oxide. The film may additionally comprises metallic chromium.

The magnetic amorphous alloy according to the present invention is suitable for use as a transformer core achieving a high building factor.

9 Claims, No Drawings

MAGNETIC AMORPHOUS ALLOY SHEET HAVING A FILM THEREON

BACKGROUND OF THE INVENTION

1. Field of the Invention

The present invention relates to magnetic material and particularly to a magnetic amorphous alloy sheet. More particularly, the present invention relates to a magnetic amorphous alloy sheet on which a film is applied so as to minimize deterioration of the magnetic properties thereof when blanked sections of the mangetic amorphous alloy sheet are laminated or when the magnetic amorphous alloy sheet is wound.

The core of electrical machinery and apparatuses, for example, a transformer, must be comprised of magnetic material, the fundamental properties of the material being a high saturation flux density, a low watt loss, and a high permeability. The core material must exhibit these fundamental properties when it is shaped or worked so that it has a toroidal form or a laminated form. The watt loss and permeability are, however, liable to be influenced by the working of or shaping of a magnetic material sheet. The watt loss and permeability usually deteriorate when stress is induced in a magnetic material sheet due to the working or shaping thereof. The ratio of a magnetic property of a core to a magnetic property of a magnetic material sheet is referred to as the building factor.

Usually, the watt loss is the magnetic property used for determining the building factor. A small building factor, that is, a building factor close to 1.00, indicates a more preferred magnetic property in the light of practical application of the magnetic material.

With regard to a grain-oriented electrical sheet, when a wound core is formed from a grain-oriented electrical steel sheet, the building factor ranges from 1.1 to 1.3.

2. Description of the Prior Art

An amorphous alloy is a metal alloy, the atomic arrangement of which is a random arrangement such as that in liquid form. An amorphous alloy can be produced by dropping on a cooled substrate molten metal containing a vitrification element and supercooling the molten metal. The composition of an amorphous alloy having good magnetic properties is one consisting of one or more of Fe, Co, and Ni in a total amount of from 70 atomic % to 88 atomic %, B in an amount of from 7 atomic % to 25 atomic %, and one or more of Si, P, and C in an amount balancing the above-mentioned Fe, Co, Ni, and B. One or more of Cr, Mo, Nb, and V may occasionally be added to the composition in an amount of up to 5 atomic %.

Since an amorphous alloy can be easily produced by the method described hereinabove and since it has many superior properties as compared with a crystalline alloy, it has attracted attention as an alloy which can be used for practical purposes. Especially, an amorphous alloy has a number of superior magnetic properties as compared with conventional magnetic materials, that is, the watt loss of an amorphous alloy is approximately one tenth or less lower than that of a grain-oriented electrical steel sheet, the permeability is higher than that of Permalloy, e.g., Ni—20%~25% Fe alloy, and the magnetic flux density is higher than that of ferrite. Thus, an amorphous alloy is most practically applied in the field of magnetic materials.

The term "magnetic amorphous alloy" herein means an amorphous alloy having a good watt loss, permeability, and/or magnetic flux density which enable it to be used in electrical machinery and devices, such as a transformer, and particularly means an amorphous magnetic alloy having the composition given hereinabove.

When a magnetic amorphous alloy is used as the core of a transformer, it is usually used as a wound core in which a magnetic amorphous alloy sheet is wound in a toroidal form or as a laminated core in which sections or pieces of a magnetic amorphous alloy sheet are laminated.

A magnetic amorphous alloy generally has a high building factor. For example, when a wound core having an inner diameter of 40 mm is formed by winding a magnetic amorphous alloy core, the building factor ranges from 1.5 to 2.0. A magnetic amorphous alloy has strain-sensitive magnetic properties and cannot be subjected to high-temperature stress relief annealing so as to satisfactorily remove the stress, stress relief annealing usually being carried out at a temperature from 360° C. to 380° C. for a time period of from 30 to 60 minutes. A magnetic amorphous alloy does not crystallize at a temperature from 360° C. to 380° C., but stress relief annealing at this temperature is unsatisfactory for relieving the stress. Therefore, due to the strain-sensitive magnetic properties, which do not allow a magnetic amorphous alloy to be subjected to high-temperature stress relief annealing, the building factor thereof is low.

As is known, the building factor is influenced by the layer insulation resistance of a core. That is, the building factor increases by increase in the eddy current which flows across a layer when the layer insulation resistance of a core is low. In order to provide a low-building-factor core comprising a grain-oriented electrical steel or Permalloy sheet, an insulating film is applied on the sheet.

Since a magnetic amorphous alloy has a resistivity a few times higher than that of crystalline magnetic materials, such as a grain-oriented electrical steel and Permalloy, the eddy current induced in the magnetic amorphous alloy is inherently small. In addition, since magnetic amorphous alloy sheets have appropriate unevennesses which prevent face contacts therebetween, the layer insulation resistance is high. Therefore, it is believed by persons skilled in the art that it is not necessary to increase the layer insulation resistance by applying an insulating film on a magnetic amorphous alloy sheet.

As is known, the building factor is enhanced when rust forms on a magnetic material sheet since the magnetic properties thereof are thereby impaired and since the magnetic material sheet becomes locally thick in the regions of rust formation. Conventional magnetic alloy material is not so good corrosion-resistant and therefore does not effectively prevent the formation of rust.

SUMMARY OF THE INVENTION

It is an object of the present invention to provide a magnetic amorphous alloy sheet which has a high building factor.

Before completing the present invention, the inventors carried out experiments by applying a film on magnetic amorphous alloy sheets. In these experiments, the building factor was considerably enhanced due to the application of a film. The inventors then recognized that in order to reduce the building factor, each of the film on an amorphous alloy sheet must be capable of insulating other sheets which are very thin and have surfaces of minute unevennesses.

The inventors also conceived the idea of forming a film which is insulative, which does not cause to deteriorate the magnetic properties of a magnetic amorphous alloy sheet, and which can suppress a watt loss increase due to an eddy current. The inventors recognized that, especially, when a magnetic amorphous alloy sheet is used as a large-sized wound core, an insulating film should be applied on the magnetic amorphous alloy sheet since the magnetic amorphous alloy sheet can attain a layer insulation resistance of from merely 0.5 to 1 $\Omega$-cm$^2$/sheet without an insulating film while a large-sized wound core is required to have a layer insulation resistance of from 2 to 5 $\Omega$-cm$^2$/sheet.

The present inventors also carried out experiments to attain good corrosion resistance for magnetic amorphous alloy sheets. In the experiments, when magnetic amorphous alloy sheets which were not subjected to surface treatment exposed to the indoor atmosphere of a laboratory for a time period of from ten days to one month, many small spots of rust formed on the surfaces of the magnetic amorphous alloy sheets. The corrosion resistance of the magnetic amorphous alloy sheets could be improved by treating them with adding chromium thereto, but the magnetic flux density thereof was too low for them to be used as a wound core.

The inventors also carried out phosphating-treatment film which is applied on grain-oriented electrical steel sheets on magnetic amorphous alloy sheets. The layer insulation resistance was advantageously enhanced when the phosphating-process film was uniformly applied on the magnetic amorphous alloy sheets. However, the watt loss was disadvantageously greatly enhanced due to stress induced in the magnetic amorphous alloy sheets. When the phosphating-process film was heated to and annealed at from 360° C. to 380° C., stress appeared to be induced due to dehydration of the hydrates contained in the phosphating-process film during the heating and annealing.

In accordance with the objects of the present invention, there is provided a magnetic amorphous alloy sheet having an improved insulating property and an improved corrosion resistance, characterized in that a film having a thickness of up to 1 $\mu$m and comprising a chromium compound which comprises hydrated chromium oxide is applied on the surface of the magnetic amorphous alloy sheet.

A film thickness of up to 1 $\mu$m, preferably up to 0.5 $\mu$m, is selected so that the film covers, without decreasing the space factor, the magnetic amorphous alloy sheet, which has a thickness ranging from approximately 20 $\mu$m to approximately 100 $\mu$m and which has unevennesses of a few microns on the surface thereof. The minimum film thickness is preferably at least 0.005 $\mu$m. The film material is selected so that the watt loss can be low and a high layer insulation resistance can be obtained with a thin film thickness. If a film consisting of a conventional organic resin is used, it is not possible to obtain a layer insulation resistance of from 2 to 5 $\Omega$-cm$^2$/sheet or more unless the film thickness exceeds 1 $\mu$m. Furthermore, if an organic resin film is applied on the magnetic amorphous alloy sheet and the magnetic amorphous alloy sheet is then subjected to stress relief annealing at a temperature of from 360° C. to 380° C., the organic resins can not withstand such a high temperature.

The film material according to the present invention is mainly composed of hydrated chromium oxide and may additionally contain metallic chromium. The film material according to the present invention attains a high corrosion resistance and a high layer insulation resistance even when the film thickness is very thin.

The film according to the present invention is applied directly on the surface of a conventional magnetic amorphous alloy sheet. Directly after the magnetic amorphous alloy sheet is formed, a very thin oxide layer is formed thereon. Such a very thin oxide layer is not detrimental to the formation of the film according to the present invention, and, therefore, the film according to the present invention may be formed on a magnetic amorphous alloy sheet having a very thin oxide film thereon.

The film according to the present invention can be formed by the following procedure. First, the magnetic amorphous alloy sheet is pickled or mechanically polished, if necessary, to remove a thick oxide layer thereon. Subsequently, the magnetic amorphous alloy sheet is subjected to one of the following:

1. A cathodic electrolytic deposition process in which the magnetic amorphous alloy sheet, which is a cathode, is dipped in an aqueous solution containing chromic acid.

2. A dipping process in which the magnetic amorphous alloy sheet is dipped in an aqueous solution containing chromic acid.

3. A spraying process in which an aqueous solution containing chromic acid is sprayed on the magnetic amorphous alloy sheet and then the magnetic amorphous alloy sheet is squeezed with rollers or an air knife and is dried.

In the cathodic electrolytic deposition process, if sulfuric acid ions or fluorine ions are present in the bath, first, metallic chromium deposits on and then the hydrated chromium oxides deposit on the magnetic amorphous alloy sheet. Although metallic chromium is conductive a film which comprises chromium hydrates in the upper surface portion thereof is highly insulative and corrosion-resistant. The film formed by one of the above processes is dried by heating it.

In the above-described processes, chromium ions are present in the bath as hexavalent to trivalent chromium aqua ions in which the water molecules are coordinated. The chromium compounds formed on the workpiece are three-dimensional inorganic polymers having a Cr-OH-Cr structure. The dehydration of chromium compounds takes place when the film is dried by heating it, resulting in a polymer having a Cr-O-Cr bond. Such a polymer is usually referred to as hydrated chromium oxide.

In the above-described processes, in order to provide a film having an enhanced strength and density and improved insulative properties, one or more of silica sol, alumina sol, titanium oxide sol, an inorganic polymer such as aluminum biphosphate or magnesium biphosphate, a water-soluble or water-dispersible organic polymer such as an acryl resin polymer, a vinyl resin polymer, a phenol resin polymer, and an epoxy resin polymer, can be incorporated into the aqueous solution containing chromic acid. Silica sol and the like are incorporated into the film according to the present invention. Silica sol and the like reinforce a film which comprises hydrated chromium oxide.

The film thickness can be controlled in the range of from 0.005 $\mu$m to 1 $\mu$m, preferably from 0.01 $\mu$m to 0.5

μm, by adjusting the chromic acid concentration, viscosity, and temperature of the bath, the surface shape of and the pressure of the squeezing rollers, the shape and pressure of the air knife, the current density and time of the electrolytic processes, and the like. If the film thickness is less than 0.005 μm, the corrosion resistance and the layer insulation resistance are not good enough. If the film thickness is more than 1 μm, a decrease in the space factor and an increase in the watt loss are likely to occur. In addition, the cracks are liable to form in the film, which is disadvantageous in regard to the adhesive properties of the film.

The film thickness can be determined by the following procedures.

First, the specific gravity of the film is determined. That is, magnetic amorphous alloy sheet is polished in optical order, thereby removing the minute unevennesses present on the magnetic amorphous alloy sheet when it is formed. Then the magnetic amorphous alloy sheet, having an optically smooth surface is subjected to a process, in which a film which comprises a chromium compound comprising hydrated chromium oxide and which occasionally additionally comprises silica sol and the like is formed. The weight per unit area of the film and the thickness of the film are determined by means of ellipsometry, so as to calculate the specific gravity of the film.

Second, a magnetic amorphous alloy sheet is subjected to the above process and the weight of the film is determined. The determined weight is then divided by the specific gravity to obtain the average thickness of the film.

The film thickness valves which is determined by the above procedures are the average values of thin portions and thick portions of the film which are formed on the convex and concave surface portions, respectively, of the magnetic amorphous alloy sheet.

The chromium content of a film can be determined by means of chemical analysis, in which the film is dissolved in a caustic alkali solution and then insoluble portion is identified as the metallic chromium and soluble portion is quantitatively analyzed to determine chromium compounds. The chromium content can be more accurately determined by using a scanning-type electron-probe-micro-analyzer in which the chromium concentration distribution in one direction across the surface of the film is determined.

The compositon of a magnetic amorphous alloy sheet according to the present invention is not limited to a specific one but should not contain chromium. The magnetic amorphous alloy may consist of one or more of Fe, Co, and Ni in a total amount of from 70 atomic % to 88 atomic %, B in an amount of from 7 atomic % to 25 atomic %, and one or more of Si, P, and C in an amount balancing the above-mentioned Fe, Co, Ni, and B.

The present invention is further explained by way of the following examples.

EXAMPLE 1

A magnetic amorphous alloy sheet having a nominal thickness of 30 μm and minute unevennesses of ±2 μm was produced. The magnetic amorphous alloy sheet consisted of 80 atomic % Fe, 2 atomic % Ni, 12 atomic % B, 5.5 atomic % Si, and 0.5 atomic % C.

The magnetic amorphous alloy sheet was subjected to the following process so as to form a film mainly comprising hydrated chromium oxide. First, the magnetic amorphous alloy sheet was immersed in a 2% HF aqueous solution and then was rinsed. The magnetic amorphous alloy sheet was subjected for 2 seconds to cathodic electrolytic deposition at a current density of 30 A/dm$^2$ and a temperature of 40° C. using an aqueous solution containing 100 g/l of chromic acid and 1 g/l of sulfuric acid. Next, the magnetic amorphous alloy sheet was rinsed and was immersed in an aqueous solution containing 50 g/l of chromic acid, 10 g/l (in terms of $SiO_2$) of silica sol, and 2 g/l of polyvinyl alcohol. The magnetic amorphous alloy sheet was squeezed with rubber rollers having a flat surface and subsequently was heated and dried at 250° C. for 20 seconds.

The film thickness was determined by means of the above-described procedures, that is, the specific gravity was determined by means of ellipsometry, and the film weight was determined by calculating difference in the weight of the workpiece. The film consisted of a 0.015 μm±0.002 μm metallic chromium portion which was directly deposited on the magnetic amorphous alloy sheet and a 0.070 μm±0.013 μm hydrated chromium oxide portion which was deposited on the metallic chromium portion. The film thickness was 0.085 μm±0.015 μm.

The magnetic properties of the amorphous alloy sheet having the film thereon are shown in the Table, below.

EXAMPLE 2

The magnetic amorphous alloy sheet of Example 1 was immersed in a 2% HF aqueous solution and then was rinsed. Nest, the magnetic amorphous alloy sheet was immersed in an aqueous solution containing 50 g/l of ammonium bichromate, 10 g/l of aluminum biphosphate, and 5 g/l of polyacrylamide. Then the magnetic amorphous alloy sheet was squeezed with rubber rollers having a grooved surface, and subsequently was heated and dried at 250° C. for 20 seconds. The film thickness, which was 0.52 μm+0.06 μm was determined by the same procedures as in Example 1.

For the purpose of comparison, a film was not formed on the magnetic amorphous alloy sheet of Example 1.

| | | Layer Insulation Resistance* (Ω-cm$^2$/Sheet) | Rust-Proofing Humidity Test** | Watt Loss After Annealing at 380° C. for 60 min. W 1.3/50 W/kg |
|---|---|---|---|---|
| Invention | Example 1 | 12 ~ 18 | Acceptable | 0.115 ~ 0.120 |
| | Example 2 | 20 ~ 45 | Acceptable | 0.108 ~ 0.121 |
| Comparative Example | | 0.8 ~ 1.2 | rusts Spots formed | 0.120 ~ 0.124 |

*The layer insulation resistance was tested by means of the method stipulated in JIS-C 2500.

**The rust-proofing humidity was tested by exposing the samples for one hour to air having a temperature of 49° C. and a relative humidity of 98%.

+The watt loss $W_{1.3/50}$ was the value at 50 Hz and a magnetic flux density of 1.3 Tesla.

As is apparent from the Table, the magnetic amorphous alloy sheets which had a film according to the present invention (Examples 1 and 2) had a high layer insulation resistance, and were corrosion-resistant, and had a low watt loss as compared with the comparative sample. It appears that the influence of strain applied to a magnetic amorphous alloy sheet is mitigated due to the tension effect of the film.

We claim:

1. A magnetic amorphous alloy sheet having an improved insulating property and an improved corrosion resistance, wherein the improvement comprises a film having a maximum thickness of 1 μm disposed on and covering the surface of said magnetic amorphous alloy sheet wherein said film consists essentially of hydrated chromium oxide.

2. A magnetic amorphous alloy sheet according to claim 1, wherein said film has a thickness of from 0.005 μm to 0.5 μm.

3. A magnetic amorphous alloy sheet according to claim 1, wherein said film is formed by the process of cathodic electrolytic deposition.

4. A magnetic amorphous alloy sheet according to claim 1, wherein said film is formed by the process of immersing said magnetic amorphous alloy sheet in an aqueous solution containing chromium ions.

5. A magnetic amorphous alloy sheet having an improved insulating property and an improved corrosion resistance, wherein the improvement comprises a film having a maximum thickness of 1 μm disposed on and covering the surface of said magnetic amorphous alloy sheet wherein said film consists essentially of hydrated chromium oxide and metallic chromium.

6. A magnetic amorphous alloy sheet according to claim 5, wherein said film has a thickness of from 0.005 μm to 0.5 μm.

7. A magnetic amorphous alloy sheet according to claim 5, wherein said film is formed by the process of cathodic electrolytic deposition.

8. A magnetic amorphous alloy sheet according to claim 5, wherein said film is formed by the cathodic electrolytic process of immersing said magnetic amorphous alloy sheet in an aqueous solution containing chromium ions.

9. A core of a transformer comprising at least one magnetic amorphous alloy sheet, wherein the improvement comprises a film having a maximum thickness of 1 μm disposed on and covering the surface of said magnetic amorphous alloy sheet wherein said film consists essentially of hydrated chromium oxide.

* * * * *